US010981027B2

(12) United States Patent
Reda

(10) Patent No.: US 10,981,027 B2
(45) Date of Patent: Apr. 20, 2021

(54) HAND EXERCISER

(71) Applicant: Yunga Tart LLC, Edina, MN (US)

(72) Inventor: Kareem Reda, Minnetonka, MN (US)

(73) Assignee: YUNGA TART LLC, Edina, MN (US)

( * ) Notice: Subject to any disclaimer, the term of this patent is extended or adjusted under 35 U.S.C. 154(b) by 94 days.

(21) Appl. No.: 15/991,713

(22) Filed: May 29, 2018

(65) Prior Publication Data

US 2019/0366145 A1 Dec. 5, 2019

(51) Int. Cl.

| | |
|---|---|
| ***A63B 21/00*** | (2006.01) |
| ***A63B 21/02*** | (2006.01) |
| ***A63B 23/16*** | (2006.01) |

(52) U.S. Cl.

CPC ..... *A63B 21/00069* (2013.01); *A63B 21/023* (2013.01); *A63B 23/16* (2013.01)

(58) Field of Classification Search

CPC . A63B 21/00069; A63B 21/023; A63B 23/16; A63B 21/4047–4049

See application file for complete search history.

(56) References Cited

U.S. PATENT DOCUMENTS

| | | | | |
|---|---|---|---|---|
| 4,753,434 | A | 6/1988 | Salvino | |
| 5,409,436 | A | 4/1995 | Chang | |
| 6,319,175 | B1 | 11/2001 | Wu | |
| D460,505 | S | 7/2002 | Yang | |
| 6,786,849 | B1 | 9/2004 | Faulconer | |
| D521,086 | S | 5/2006 | Faulconer | |
| 7,077,787 | B1 | 7/2006 | Wiesman | |
| D561,850 | S | 2/2008 | Yang | |
| 7,824,311 | B1 * | 11/2010 | Hsu | A63B 21/4047 482/126 |
| D742,463 | S | 11/2015 | An | |
| 9,415,262 | B2 * | 8/2016 | An | A63B 23/16 |
| 2008/0103026 | A1 * | 5/2008 | An | A63B 21/023 482/49 |
| 2015/0031507 | A1 | 1/2015 | Vedeloff et al. | |
| 2015/0290491 | A1 * | 10/2015 | An | A63B 21/023 482/49 |

* cited by examiner

*Primary Examiner* — Jennifer Robertson

*Assistant Examiner* — Catrina A Letterman

(74) *Attorney, Agent, or Firm* — Westman, Champlin & Koehler, P.A.; Z. Peter Sawicki; Amanda M. Prose

(57) ABSTRACT

A hand exercising device with selectively adjustable strength includes a first and second handle pivotably coupled with a spring biased between them, the spring pivotably coupled to the first handle, and a spring positioner coupled to an end of the spring configured to be selectively positioned among a plurality of grooves within the second handle.

15 Claims, 4 Drawing Sheets

HAND EXERCISER

BACKGROUND

The present disclosure is related to hand exercisers. More specifically, the present disclosure is related to adjustable strength hand exercisers.

A hand exercising device, or hand exerciser, is a type of exercise equipment that may be used to strengthen the muscles involved in a hand grip, such as muscles in the hand, wrist, or forearm. The hand exercising device may be used to train muscle strength by the repetitive closure of the device against a resistive force, such as a spring. For example, a hand exercise device may comprise a pair of handles coupled with a compressible spring biased between them. The spring provides a resistive force which is compressed by squeezing the handles, and the spring is relaxed by releasing the handles. Thus, a user may apply a force to overcome the resilient force of the spring and exercise the hand. However, many hand exerciser devices provide a single strength and are not selectively adjustable, or provide adjusting mechanisms that have ambiguous strength levels or are difficult to use.

SUMMARY

This Summary and Abstract are provided herein to introduce a selection of concepts in simplified form that are further described below in the Detailed Description. The Summary and Abstract are not intended to identify key features or essential features of the claimed subject matter, nor are they intended to be used as an aid in determining the scope of the claimed subject matter. The claimed subject matter is not limited to the implementations that solve any or all the disadvantages noted in the background.

A hand exercising device of the disclosure may include a first handle, a second handle pivotally coupled with the first handle, a spring biased between the first and second handles with the spring pivotally coupled to the first handle, and a spring positioner coupled to an end of the spring configured to be selectively positioned among a plurality of grooves within the second handle.

A method of using a hand exerciser includes providing a first handle and a second handle with a spring biased between them, positioning a spring positioner disposed on the spring among one of a plurality of grooves on the second handle, engaging a pin disposed within the spring positioner to one of the plurality of grooves, and compressing the spring by decreasing the distance between the first and second handles.

DETAILED DESCRIPTION

The present disclosure generally pertains to a hand exercising device with an adjustable strength.

Figure 1:
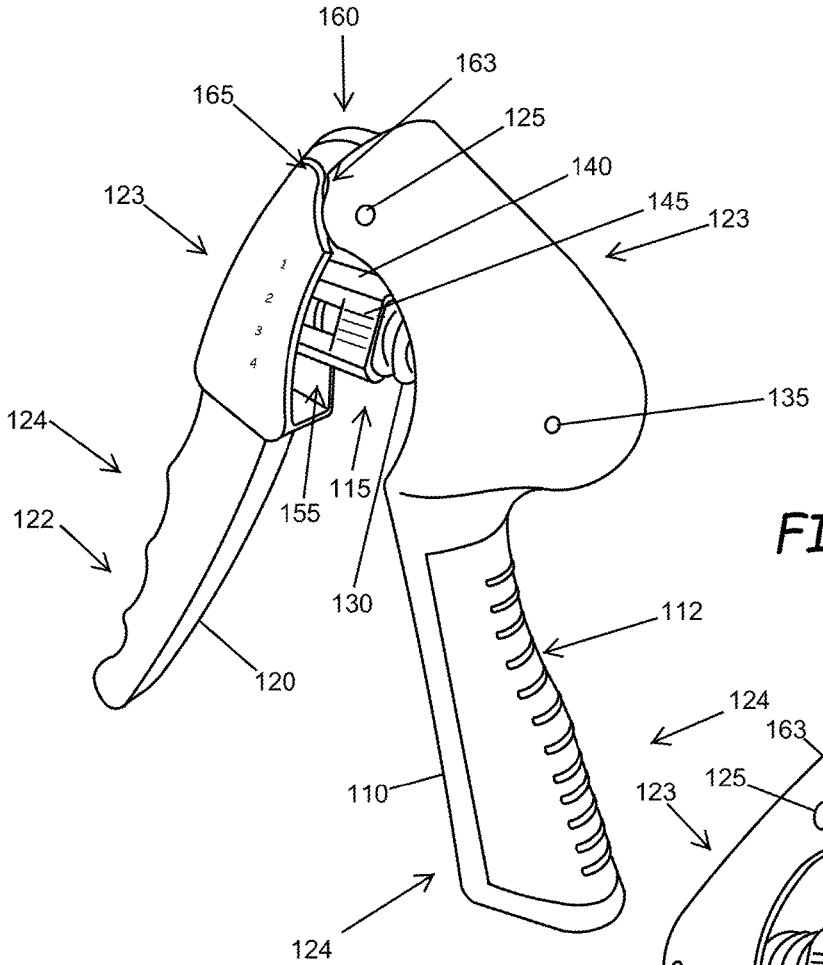
FIG. 1-3 illustrate perspective side views of an embodiment of the present disclosure.
Figure 2:
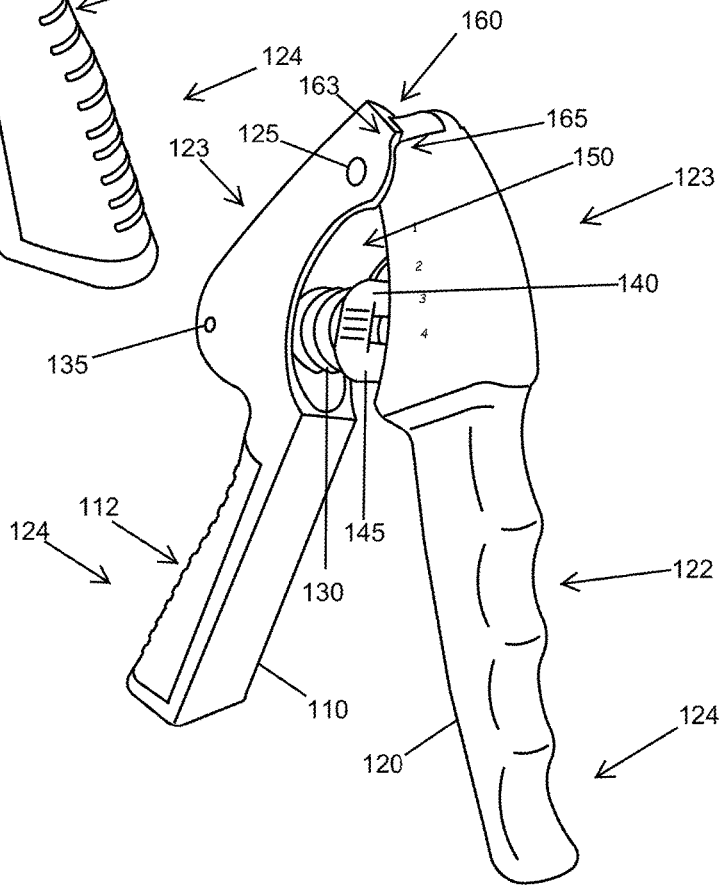
Figure 3:
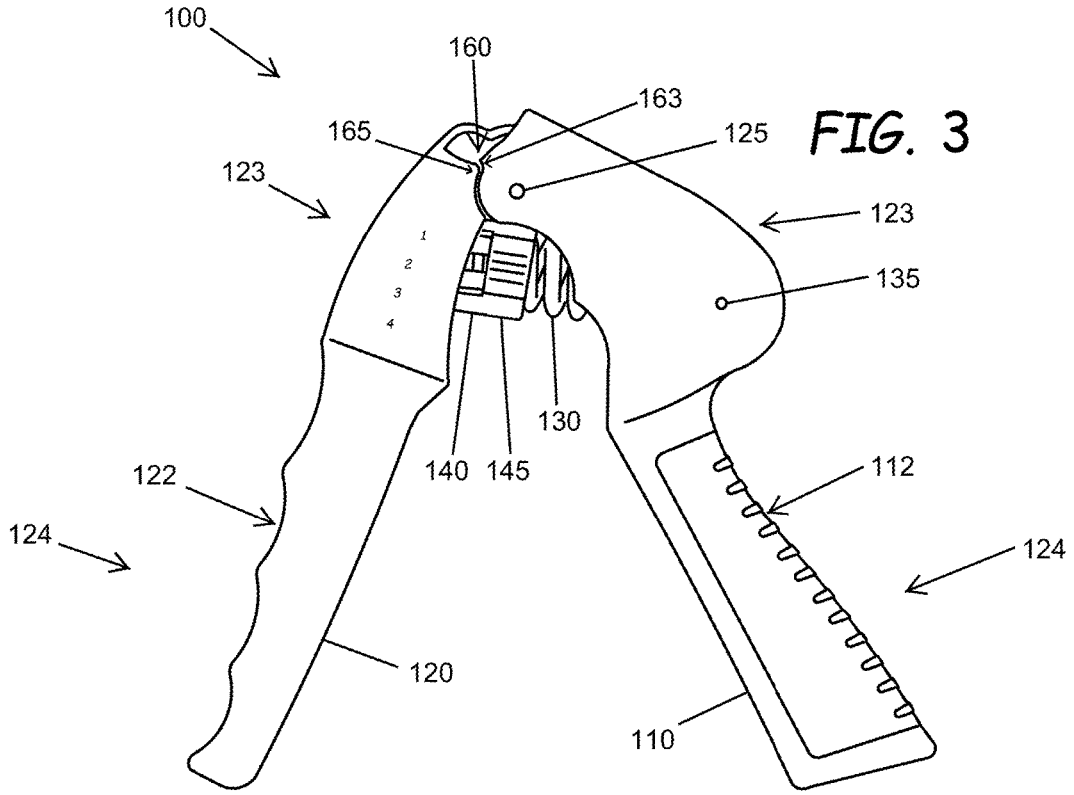

FIGS. 1-3 illustrate a perspective side view of a hand exercising device 100. Device 100 includes a first handle 110 and a second handle 120 coupled by a pivot 125 on their respective upper portions 123 and includes a spring 130 biased between the first handle 110 and second handle 120. First and second handles 110, 120 may be brought together, such that a distance between a lower portion 124 of the handles 110, 120 will decrease. The spring 130 biased between the handles 110, 120 provides a resistive force, and exerts an opposing force approximately proportional to its change in length when compressed. Thus, when the handles 110, 120 are pressed towards each other, the spring 130 is compressed and exerts a force which may be overcome. The spring 130 may be coupled to the first handle 110 at a pivot end with a spring pivot 135 to allow the spring 130 to rotate freely. The spring 130 further includes a spring positioner 140 disposed on a positioning end of the spring 130 opposite the pivot end. An opening 115 formed between handles 110, 120 allows access to the sides of spring positioner 140 on spring 130.

Spring positioner 140 may include a grip portion 145 which is accessible through opening 115. Spring positioner 140 may be selectively moveable to one of a plurality of grooves 410 (FIG. 4) located on the second handle 120. The force used to compress the spring may be increased or decreased by selectively moving the spring positioner 140 to one of the plurality of grooves 410 disposed on the second handle.

Spring 130 may be coupled to pivot 135 within a first cavity 150 located within the upper portion 123 of first handle 110. First cavity 150 partially encloses spring 130 and allows freedom of motion in a limited range. A second cavity 155 within upper portion 123 of second handle 120 includes a plurality of grooves 410 inside the second handle 120. Second cavity 155 is configured to partially enclose spring positioner 140 on the positioning end of spring 130 and allows a freedom of motion in a limited range. Second cavity 155 is configured to allow access to the plurality of grooves 410 on second handle 120.

A pin 420 (FIG. 4) is configured to engage the plurality of grooves 410 within second cavity 155 and may traverse within spring 130 running from pivot 135 through spring positioner 140. For example, pin 420 may be coupled to pivot 135 and internally traverse through spring 130 and spring positioner 140 to selectively engage one of the plurality of grooves 410. In another example, a sheath (not shown) may be provided to couple with pivot 135, such that pin 420 is slidably coupled in the sheath, allowing the pin 420 to internally traverse through spring 130 and spring positioner 140, and to selectively engage one of the plurality of grooves 410. Thus, as the spring 130 is compressed by handles 110, 120, pin 420 may remain engaged in one of the plurality of grooves 410, and will slide within the sheath coupled to pivot 135 as spring 130 shortens in length. When spring 130 is allowed to relax, pin 420 will again remain engaged in one of the plurality of grooves 410, and slide within the sheath as spring 130 extends in length.

Alternatively, pin 420 may be disposed on spring positioner 140 to engage the plurality of grooves 410. In another example, pin 420 may comprise a detent pin configured to engage one of the plurality of grooves 410 through movement of the spring positioner 140 within second cavity 155. Thus, when pin 420 engages one of the plurality of grooves 410 within second cavity 155, the spring 130 will be positioned at a desired strength level, such that spring 130 will exert a corresponding force when compressed. Therefore, the strength of the hand exercising device 100 may be increased or decreased by selective movement of the spring positioner 140 among the plurality of grooves 410 in the second handle 120.

A variety of materials may be used to form device 100 such as metal, plastic, or other materials. For example, device handles, such as handles 110, 120, and spring positioner, such as spring positioner 140, may be formed of plastic, metal, or other materials to provide strength with a light weight. A spring, such as spring 130, may be formed of a variety of elastic materials, such as spring steel to provide a compression load when operated. A pin, such as pin 420, may be formed of metal. Although various materials may be disclosed, one skilled in the art will recognize that changes may be made without departing from the scope of the disclosure.

A stop system 160 on device 100 may include symmetrical divots 163 on either side of the upper portion 123 of the first handle 110 and symmetrical protrusions 165 on either side of the upper portion 123 of the second handle 120. Divots 163 and protrusions 165 are configured to engage when the first and second handles 110, 120 are separated relative to each other at a fully extended position. Stop system 160 engages when handles 110, 120 are separated at a maximal position and prevents a spring assembly formed of spring 130, spring positioner 140 and pin 420, from vacating cavity 155 in handle 120. Thus, stop system 160 prevents over extension of the handles 110, 120, and keeps the spring assembly intact within cavity 155.

Device 100 may also include a palm grip 112 on first handle 110 or a finger grip 122 on second handle 120. For example, palm grip 112 may be formed on an outside surface of the first handle 110 to secure device 100 in a user's palm, and may include a variety of bumps or ridges, or a variety of materials, such as rubber or plastic, to prevent device 100 from slipping from a user's hand when in use. Similarly, finger grip 122 may be formed of undulating protrusions on an outside surface of second handle 120 to secure a user's fingers when in use, and may include a variety of bumps or ridges, or a variety of materials, such as rubber or plastic, to prevent device 100 from slipping from a user's hand when in use. In one example, the second handle 120 may include a lower portion 124 that is tapered compared to the upper portion 123. In another example, the upper portion 123 of the first handle 110 may be elongated or extend partially over palm grip 112 to form first cavity 150 and enable spring 130 freedom of movement about pivot 135. However, the variety of shapes and materials described are exemplary only, and changes may be made in form or material without departing from the scope of the disclosure.

Figure 4:
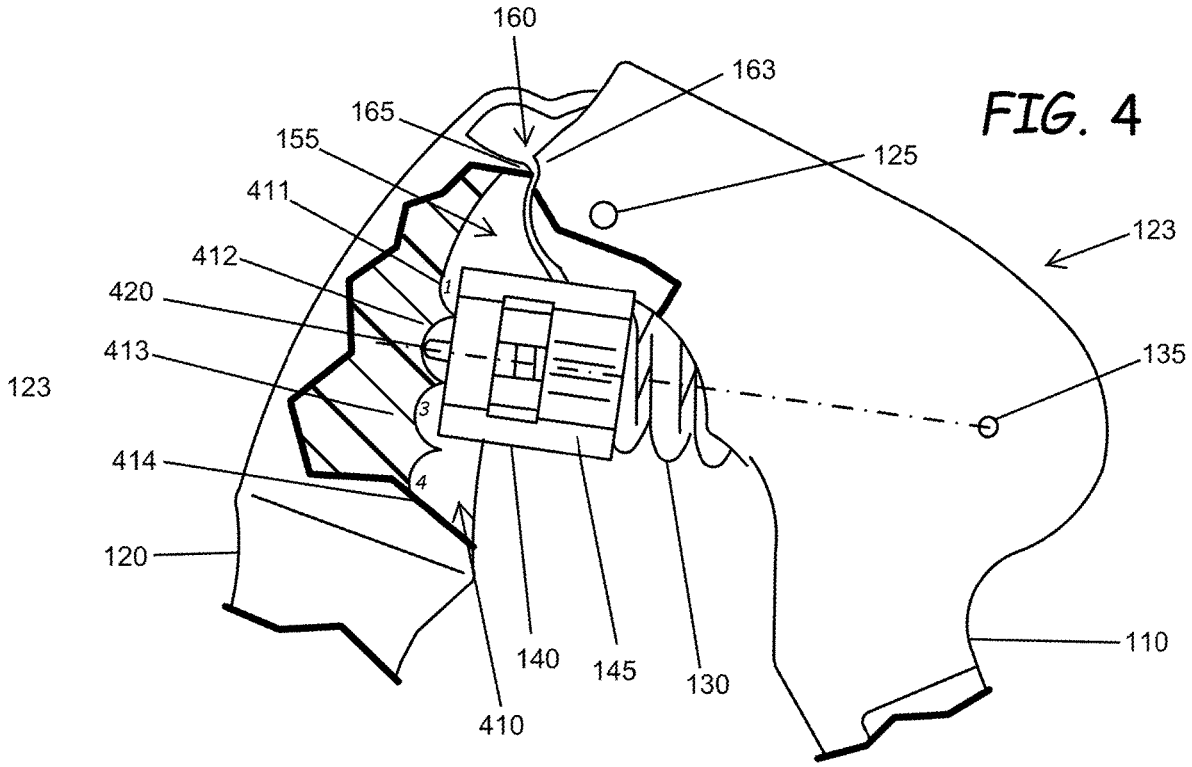
FIG. 4 illustrates a cutaway view of the embodiment of FIGS. 1-3.

FIG. 4 illustrates a cutaway view of the upper part of the hand exercise device of FIGS. 1-3. As described above, device 100 is formed by first handle 110 and second handle 120 coupled at pivot 125. Spring 130 is coupled to the first handle 110 within the first cavity 150 at pivot 135. The second handle 120 includes the plurality of grooves 410 inside cavity 155. In one embodiment, device 100 includes four grooves within cavity 155, such as first groove 411, second groove 412, third groove, 413, and fourth groove 414. Spring positioner 140 may be selectively moved within cavity 155 such that pin 420 engages one of the plurality of grooves 410 to select one of a plurality of hand grip exercise strengths.

In FIG. 4, for example, pin 420 is engaged with the second groove 412 of the plurality of grooves 410 inside cavity 155. Here, moving spring 130 to engage pin 420 in the second groove 412 corresponds to a selected strength level of device 100, such that more force is used to compress spring 130 at second groove 412 than it would at first groove 411. Similarly, more force is used to compress spring 130 when pin 420 is engaged with third groove 413 than second groove 412, and more force is used to compress spring 130 when pin 420 is engaged with fourth groove 414 than third groove 413. Thus, spring 130 may be selectively positioned by spring positioner 140 to engage pin 420 with one of the plurality of grooves 410 to increase or decrease the exercise strength of device 100.

Figure 5:
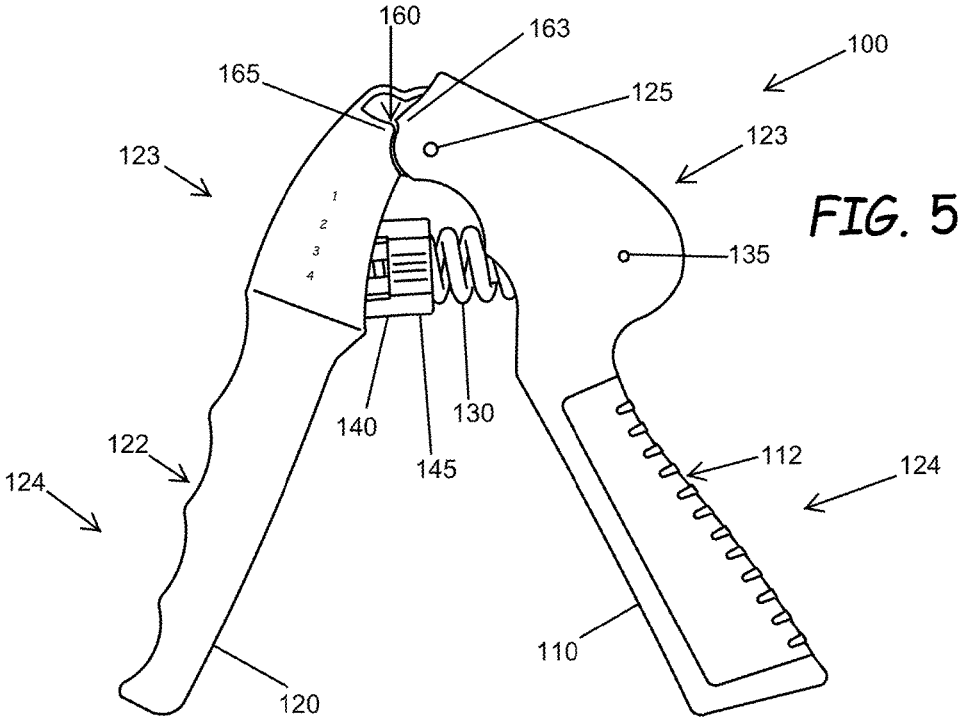
FIGS. 5-10 illustrate perspective views of the embodiment of the present disclosure.
Figure 6:
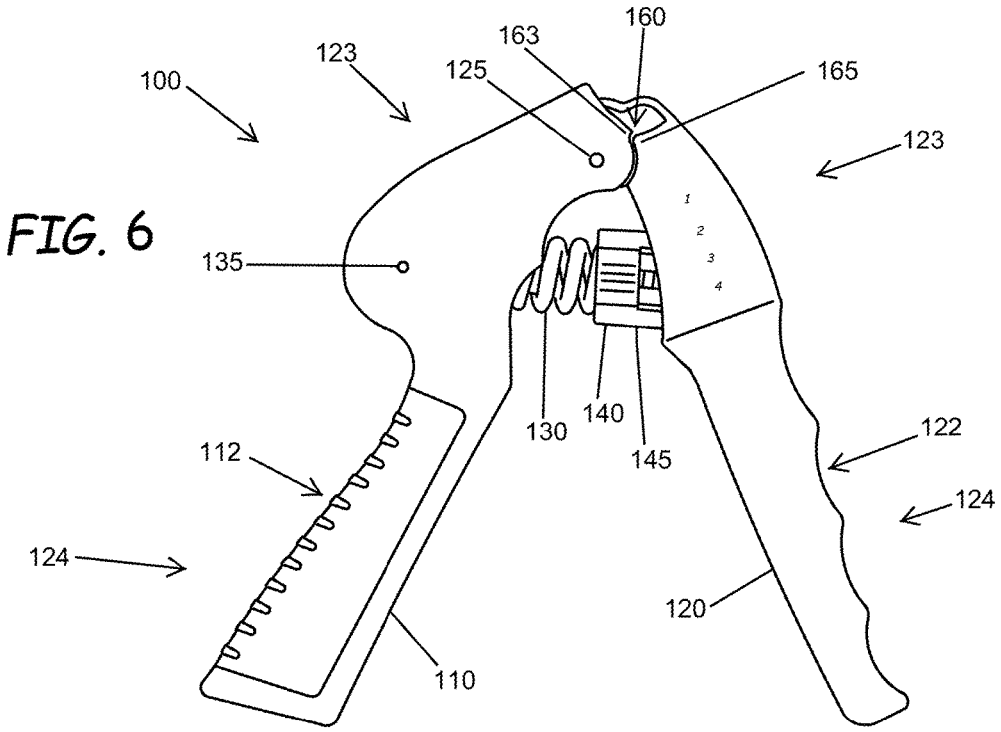
Figure 7:
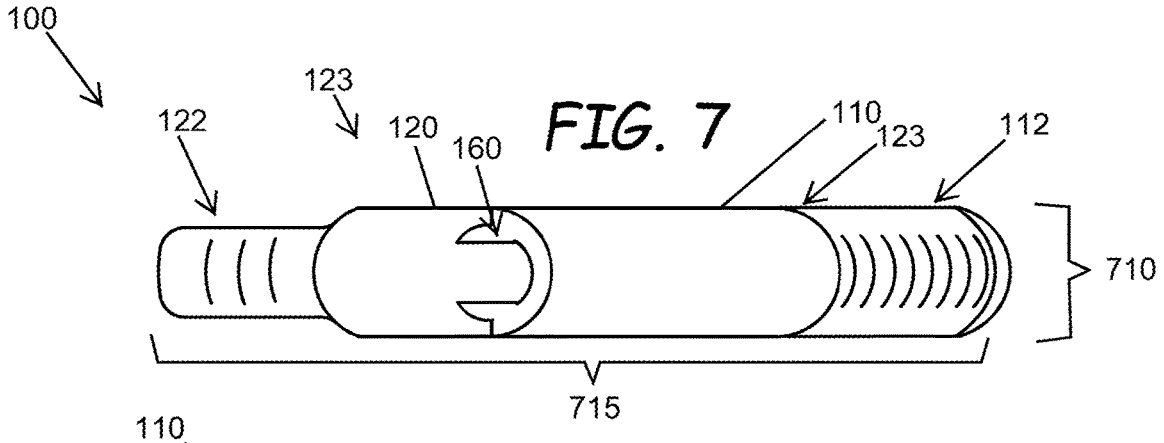

FIGS. 5-10 illustrate perspective views of embodiments of the present disclosure. FIGS. 5 and 6 illustrate side views of hand exerciser device 100 and include features as described above. FIG. 7 illustrates a top view of device 100 with first handle 110 coupled to second handle 120. Here, the first handle 120 includes palm grip 112 and the second handle 120 includes finger grip 122. The device 100 may have a width 710. In one example, device width 710 may be about 24 millimeters. Device 100 may also have a fully extended length 715, such as when stop system 160 engages when handles 110, 120 are separated at a maximal position. In one example, the length 715 of the device 100 when fully extended is about 151.25 millimeters.

Figure 8:
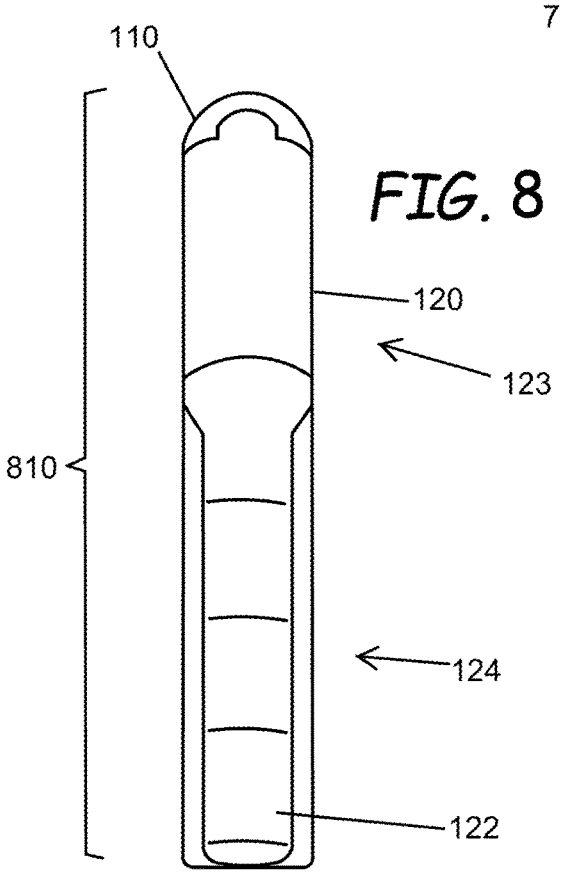

FIG. 8 illustrates a front view of device 100 showing second handle 120 with finger grip 122 coupled to first handle 110 on the upper portion 123 of the second handle 120. The first and second handle 110, 120 may have a height 810 from the lower portion 124 to the upper portion 123 of the respective handles. In one example, device height 810 may be about 154.81 millimeters.

Figure 9:
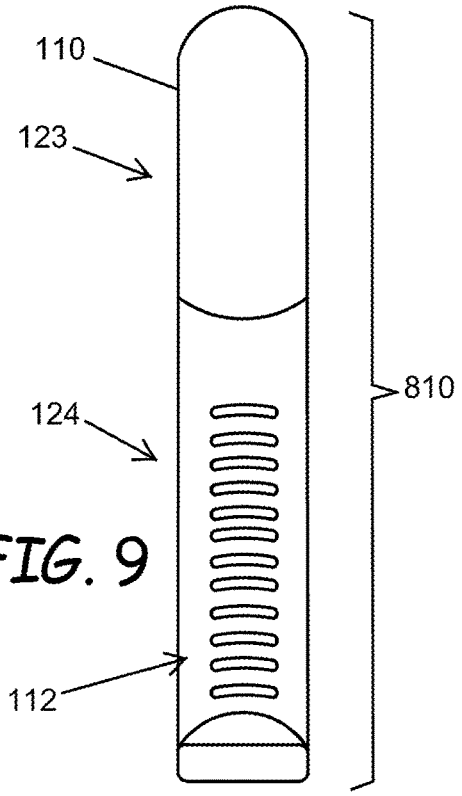
Figure 10:
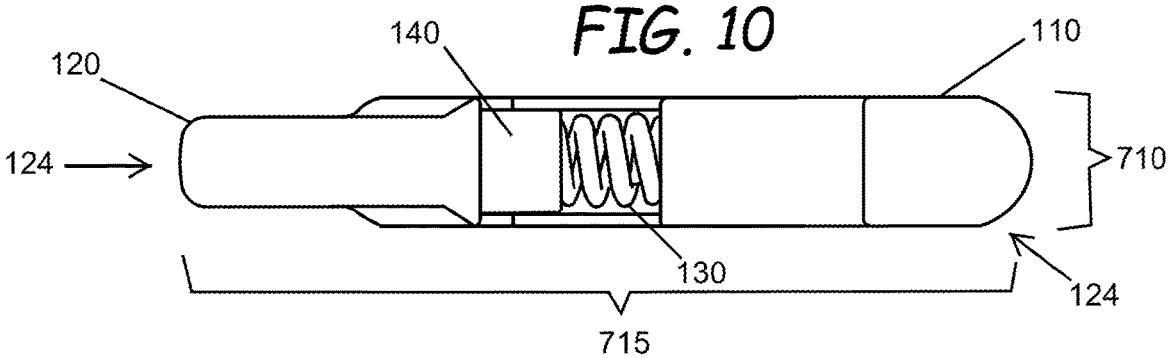

FIG. 9 illustrates a back view of device 100 showing the first handle 110 with palm grip 112. Here, device 100 may have height 810 from the lower portion 124 to the upper portion 123 of the first handle 110. FIG. 10 illustrates a bottom view of device 100 and shows the lower portion 124 of the first handle 110 and second handle 120 and includes spring 130 with spring positioner 140 biased between the handles 110, 120 to provide a resistive force.

As described above, hand exerciser device 100 includes a first handle 110, a second handle 120 pivotally coupled with the first handle 110 by pivot 125, a spring 130 biased between the first and second handles 110, 120 and pivotally coupled to the first handle 110 at pivot 135, wherein a spring positioner 140 coupled to an end of the spring 130 is configured to selectively position a pin 420 among a plurality of corresponding grooves of the second handle 120.

A method of using the hand exerciser as described may include providing first and second handles with a spring biased between them, positioning a spring positioner disposed on the spring among a plurality of grooves on the second handle, engaging a pin disposed within the spring positioner with one of the plurality of grooves, and compressing the spring by decreasing the distance between the first and second handles. The strength of hand exerciser may be selectively adjusted by movement of the spring positioner within the second cavity, e.g. second cavity 155, and engaging the pin with one of the plurality of grooves located within the second cavity.

Although the present invention has been described with reference to preferred embodiments, workers skilled in the art will recognize that changes may be made in form and detail without departing from the scope of the invention.

What is claimed is:

1. A hand exerciser comprising:

a first handle;

a second handle pivotally coupled to the first handle;

a spring biased between the first handle and second handle, wherein the spring is pivotally coupled to the first handle;

a spring positioner operably disposed on an end of the spring;

a pin at least partially disposed within the spring positioner extending away therefrom and extending through the spring disposed on the spring positioner and wherein the pin is configured to engage directly with one of a plurality of grooves through movement of the spring positioner, and wherein the spring positioner comprises a grip portion accessible through an opening between the first and second handle and for selectively moving the pin and thus the position of the spring among the plurality of grooves in the second handle.

2. The hand exerciser of claim 1, wherein the pin traverses within the spring running through the spring positioner to engage the plurality of grooves.

3. The hand exerciser of claim 1, wherein the pin comprises a detent pin.

4. The hand exerciser of claim 1 and further comprising a stop system comprised of symmetrical protrusions and divots configured to engage when said first and second handles are separated at a maximal position.

5. The hand exerciser of claim 1, wherein the spring is coupled to a pivot within a first cavity located within an upper portion of the first handle.

6. The hand exerciser of claim 1, wherein the plurality of grooves are disposed within a second cavity located within an upper portion of the second handle.

7. The hand exerciser of claim 1, wherein the plurality of grooves correspond to a plurality of exercise strength levels.

8. The hand exerciser of claim 1, wherein the plurality of grooves includes four grooves.

9. The hand exerciser of claim 1, wherein the first handle includes a palm grip.

10. The hand exerciser of claim 1, wherein the second handle includes a finger grip.

11. The hand exerciser of claim 1, wherein a lower portion of the second handle is tapered.

12. A hand exerciser comprising:

a first and second handle pivotally coupled together;

a spring positioned between the first and second handles, the spring having first and second ends, the first end of the spring being pivotally connected to the first handle and the second handle having one of a plurality of engagement positions with the second end of the spring engaging without attachment to one of the plurality of engagement positions within the second handle to vary the force when the handles are moved towards each other;

a spring positioner comprising a grip portion positioned between the spring and the second handle and for selectively moving the spring among the plurality of engagement portions within the second handle; and a pin traversing within the spring and running through the spring positioner to engage directly with the one of the plurality of grooves for positioning the spring.

13. The hand exerciser of claim 12 wherein the plurality of engagement positions includes a plurality of grooves positioned on the second handle.

14. The hand exerciser of claim 13 wherein the plurality of grooves are disposed within a cavity located within the second handle.

15. The hand exerciser of claim 12 wherein the spring is coupled to a pivot within a first cavity located within an upper portion of the first handle.

* * * * *